US008220409B2

(12) United States Patent
Goto

(10) Patent No.: US 8,220,409 B2
(45) Date of Patent: Jul. 17, 2012

(54) VARNISH COATING DEVICE AND METHOD FOR COATING A VARNISH

(75) Inventor: Masayoshi Goto, Hitachi (JP)

(73) Assignee: Hitachi Magnet Wire Corp., Hitachi-shi (JP)

( * ) Notice: Subject to any disclaimer, the term of this patent is extended or adjusted under 35 U.S.C. 154(b) by 476 days.

(21) Appl. No.: 12/000,008

(22) Filed: Dec. 6, 2007

(65) Prior Publication Data

US 2008/0159802 A1 Jul. 3, 2008

(30) Foreign Application Priority Data

Dec. 19, 2006 (JP) ..... 2006-341284
Oct. 15, 2007 (JP) ..... 2007-268016

(51) Int. Cl.
*B05C 3/12* (2006.01)
*B05C 11/00* (2006.01)
*B05C 11/02* (2006.01)

(52) U.S. Cl. ..... 118/420; 118/125; 118/712; 118/694

(58) Field of Classification Search ..... 118/125, 118/DIG. 18, 420, 694, 712, 612
See application file for complete search history.

(56) References Cited

U.S. PATENT DOCUMENTS

| | | | | | |
|---|---|---|---|---|---|
| 2,175,099 | A | * | 10/1939 | Abbott | 264/129 |
| 2,647,296 | A | * | 8/1953 | Shive | 28/169 |
| 2,647,488 | A | * | 8/1953 | Shive | 118/44 |
| 2,952,240 | A | * | 9/1960 | Abbott | 118/405 |
| 3,238,059 | A | * | 3/1966 | Stobierski | 427/345 |
| 3,461,011 | A | * | 8/1969 | Forecki | 156/171 |
| 3,922,128 | A | * | 11/1975 | Solomon | 425/113 |
| 4,637,341 | A | * | 1/1987 | Switall | 118/694 |
| 5,255,847 | A | * | 10/1993 | Sperry et al. | 239/112 |
| 6,660,086 | B1 | * | 12/2003 | Prince et al. | 118/125 |
| 2001/0024698 | A1 | * | 9/2001 | Lin et al. | 427/501 |
| 2002/0066404 | A1 | | 6/2002 | Ueberschar et al. | |
| 2004/0166244 | A1 | | 8/2004 | Ueberschar et al. | |
| 2004/0173149 | A1 | * | 9/2004 | De Vroome | 118/694 |

FOREIGN PATENT DOCUMENTS

| | | | |
|---|---|---|---|
| JP | 53-74686 | U | 6/1978 |
| JP | 3455564 | B2 | 7/2003 |
| JP | 2004-230324 | A | 8/2004 |
| JP | 2006-045484 | A | 2/2006 |
| WO | 01/38005 | * | 5/2001 |

OTHER PUBLICATIONS

Singapore Search Report of Jan. 13, 2010, 9 pages.

* cited by examiner

*Primary Examiner* — Yewebdar Tadesse
(74) *Attorney, Agent, or Firm* — Foley & Lardner LLP

(57) ABSTRACT

A first varnish 11 supplied from a first varnish tank 12 and a second varnish 13 supplied from a second varnish tank 14 are mixed by a mixer 15 to provide a varnish 2, and supplied to a varnish bath 18. Coating dies 19A-19F are connected to the varnish bath 18 via tubes 20A-20F. A wire 3 is installed into the coating dies 19A-19F through a hole **20*a* provided in each of the tubes 20A-20F. The varnish 2 supplied to the varnish bath 19 is dropped by its self weight through the tubes 20A-20F, and continuously supplied to the coating dies 19A-19F. The varnish 2 is applied to a surface of the wire 3 by the coating dies 19A-19F**.

15 Claims, 9 Drawing Sheets

VARNISH COATING DEVICE AND METHOD FOR COATING A VARNISH

The present application is based on Japanese Patent Application No. 2006-341284 filed on Dec. 19, 2006 and Japanese Patent Application No. 2007-268016 filed on Oct. 15, 2007, the entire contents of which are incorporated herein by reference.

BACKGROUND OF THE INVENTION

1. Field of the Invention

The present invention relates to a varnish coating device and a method for coating a varnish, in more particular, to a varnish coating device for coating a varnish to a wire and a method for coating a varnish.

2. Related Art

In fabrication of a wire such as an enamel wire, a wire fabricating device in that a roller is dipped into a coating bath fulfilled with a varnish, and the varnish is applied to a wire by continuously contacting the wire to a top face of this roller, thereafter the varnish applied to the wire is baked in a baking furnace has been used. Japanese Patent No. 3455564 discloses an example of such an enamel wire fabricating device.

In addition, a varnish coating device in that a varnish introducing plate having plural slits, a protecting plate, a sealing plate, and an inclined plate are layered on one side of a varnish tank having an opening at its upper part, and a varnish is filled at a predetermined position of the slit. A wire is passed through the slit to be inserted into a semi-divided hole formed in a part of the slit, thereby coating the varnish on the wire. Japanese Patent Application Laid-Open No. 2004-230324 discloses an example of such a varnish coating device.

This type of varnish coating device is provided with a varnish circulating path which supplies the varnish of a constant quantity to the coating bath, the varnish tank or the like and collects the varnish therefrom, so that the varnish of the constant quantity is pooled in the coating bath and the varnish tank, in order to conduct the coating stably.

As a conventional varnish for an enamel wire, a one-pack type (poly)urethane varnish has been used. The one-pack type (poly)urethane varnish comprises a first varnish material A and a second varnish material B each comprising a principle component having a functional group different from each other. The functional group of the first varnish material A is masked with a masking which is removed by heating, and the functional group of the second varnish material B is not masked with this masking, and the first varnish material A and the second varnish material B are mixed together with a solvent, a block agent or the like to provide a one liquid (one-pack).

This one-pack type (poly)urethane varnish does not react at a normal temperature, even though the first varnish material A is mixed with the second varnish material B, since the functional group of the varnish material A is completely masked with the masking. In the baking process, the masking is removed at a temperature of around 100° C., and the solvent is evaporated in a heating atmosphere of not less than 200° C., so that the first varnish material A and the second varnish material B are urethane-bonded. Therefore, it is possible to use the one-pack type (poly)urethane varnish in the conventional varnish coating device in which the varnish is circulated prior to the baking process.

In the one-pack type (poly)urethane varnish, an organic solvent such as phenol, cresol, and xylene is used. However, environment pollution, poisoning of living body and the like caused by the organic solvent are concerned. In addition, a price of the solvent rises suddenly due to a sudden rise of naphtha and decrease of energy resources, or the like in late years, an economical efficiency of the organic solvent is deteriorated. Therefore, a two-pack type (poly)urethane varnish using a low boiling point solvent such as acetate based solvent instead of using the organic solvent such as the cresol, phenol, and the block agent is remarked. For example, Japanese Patent Laid-Open No. 2006-045484 discloses such a two-pack type (poly)urethane varnish. In addition, since a reaction rate and a curability of the two-pack type varnish are high, it is necessary to finish the work in a short time, when applying the two-pack type varnish as an insulating coating.

Compared with the one-pack type varnish, the two-pack type varnish has following advantages.

(1) It is possible to reduce a solvent component in the varnish to be lower than half, thereby saving the resources.

(2) It is possible to reduce $CO_2$ discharged from the baking furnace to be lower than half, thereby reducing a burden on the environment.

(3) It is possible to lower a baking temperature, thereby reducing power consumption.

However, according to the conventional varnish coating device, all the varnish supplied in the coating bath or the varnish tank is not applied to the wire passing therethrough (traveling wire), and the varnish which is remained without being applied is circulated to the coating bath through the varnish circulating path. Therefore, it is impossible to apply the conventional varnish coating device to the two-pack type varnish that transforms (cures) in a short time during the circulation.

Accordingly, it is an object of the present invention to provide a varnish coating device for coating a varnish to a wire and a method for coating a varnish, by which the varnish can be applied to the wire without causing any problem, even if the varnish that transforms (cures) in a short time is used.

According to a first feature of the invention, a varnish coating device comprises:

a coating die for applying a varnish to a wire;

a varnish bath for supplying the varnish to the coating die by a self weight of the varnish; and a varnish feeding part for supplying the varnish to the varnish bath.

In the varnish coating device, the varnish bath may be configured to flow the varnish toward the coating die without stagnation.

In the varnish coating device, the varnish bath may be connected to the coating die to have an L-shape.

In the varnish coating device, the coating die may be provided with a hole for inserting the wire, and a direction of the hole is aligned with a direction of passing the wire.

In the varnish coating device, the varnish bath may be connected to the coating die directly or via a tube.

In the varnish coating device, the tube may be connected to the coating die with a curvature or a right angle.

In the varnish coating device, the tube may comprise a material has an elasticity and an insolvability with a solvent contained in the varnish.

The varnish coating device may further comprise:

a sensor for detecting a quantity of the varnish supplied to the varnish bath; and a control unit for controlling the quantity of the varnish supplied to the varnish bath based on a detection result of the sensor.

According to a second feature of the invention, a method for coating a varnish comprises:

a first step of supplying a varnish from a varnish feeding part to a varnish bath;

a second step of supplying the varnish in the varnish bath to a coating die by a self weight of the varnish;

a third step of passing the varnish and a wire through the coating die to form a varnish layer of the varnish with a predetermined thickness on a surface of the wire; and a fourth step of baking the varnish layer to form a coating film.

In the method for coating a varnish, the second step may comprise flowing the varnish toward the coating die without stagnation.

In the method for coating a varnish, the first step may comprise supplying the varnish to keep the quantity of the varnish in the varnish bath to be constant.

In the method for coating a varnish, the third step and the fourth step may be repeated until the coating film on the surface of the wire has a desired thickness.

In the method for coating a varnish, the varnish may comprise one-pack type varnish.

In the method for coating a varnish, the varnish may comprise plural-pack type varnish.

According to the present invention, it is possible to apply the varnish to the wire without causing any problem, even if the varnish which is transformed (cured) in a short time is used.

BRIEF DESCRIPTION OF THE DRAWINGS

Next, the present invention will be explained in more detail in conjunction with appended drawings, wherein.

DESCRIPTION OF THE PREFERRED EMBODIMENTS

Next, preferred embodiments according to the present invention will be explained in more detail in conjunction with the appended drawings.

(First Preferred Embodiment)

(Structure of a Varnish Coating System)

Figure 1:
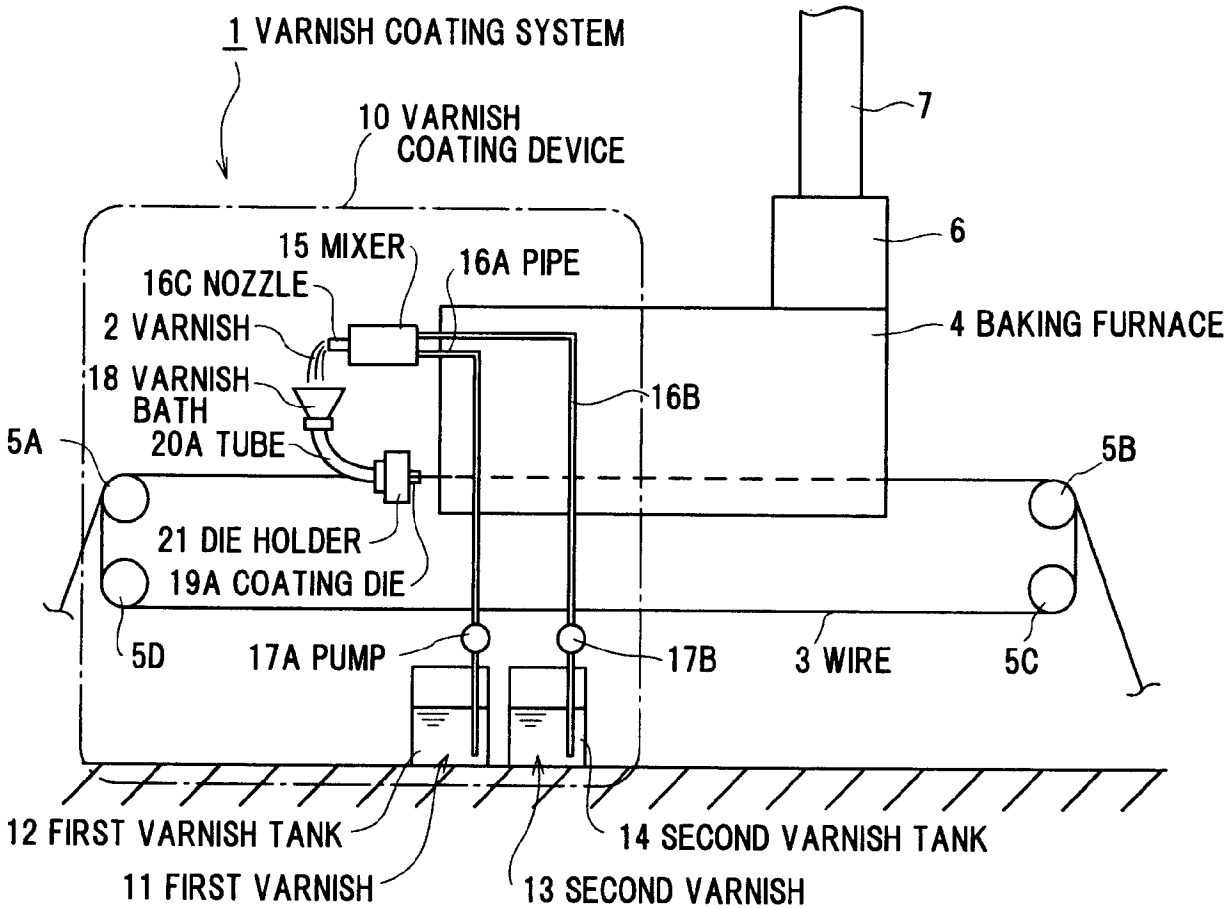
FIG. 1 is a schematic diagram of a varnish coating system in a first preferred embodiment according to the present invention.

FIG. 1 is a schematic diagram of a varnish coating system in a first preferred embodiment according to the present invention.

A varnish coating system 1 comprises a varnish coating device 10 for applying a varnish 2 made by mixing two different liquids to a wire 3, a baking furnace 4 for drying the varnish 2 applied to the wire 3, sheaves (or rollers) 5A to 5D having grooves at an outer periphery of the sheaves 5A to 5D for carrying the wire 3 such that the wire 3 can pass through the varnish coating device 10 and the baking furnace 4 for a plural times (herein, six times), a catalytic device 6 installed on the baking furnace 4, and an exhaust duct 7 installed on an exhaust port of the catalytic device 6.

In addition, a winder (not shown) or the like is installed at a later stage of the baking furnace 4 with respect to the wire 3, and illustration of these parts is omitted from FIG. 1. Similarly, a bare wire pay-off (not shown), a bare wire baking furnace (not shown) are installed at a former stage with respect to the sheave 5A. In the first preferred embodiment, the number of times for passing the rod wire 3 through the sheaves 5A to 5D is six times, however, the present invention is not limited thereto.

In this preferred embodiment, the varnish 2 comprising of a two-pack type (poly)urethane varnish made by mixing a first varnish 11 and a second varnish 13 by a mixer 15 just before application to the wire 3. The first varnish 11 is formed by mixing plural solvents with a varnish material A having a function group reacting rapidly on which an incomplete masking is provided. The second varnish 12 is formed by mixing plural solvents with a varnish material B having a function group different from the functional group of the varnish material A. The functional group of the varnish material B may be provided with an incomplete masking.

For example, a two-liquid reaction type (two-pack type) polyurethane based electrical insulation varnish comprising the first varnish 11 having an isocyanate group-containing compound and the second varnish 13 having an active hydrogen-containing compound may be used.

In general, the varnish coating device using the one-pack type varnish is a varnish circulating type coating device, in which the varnish supplied from a varnish feeding tank is applied to a surface of a traveling wire by using a coating roller, thereafter, an excessive varnish is removed by using a coating die such that the varnish is coated uniformly, and the excessive varnish is returned to the varnish feeding tank to be reused. However, when such a varnish coating device for the one-pack type varnish is used for coating the two-pack type varnish, the varnish will be cured in the varnish feeding tank and the like, so that it is difficult to conduct an operation for a long time. Therefore, it is impossible to apply the varnish coating device for the one-pack type varnish to the coating of the two-pack type varnish.

(Structure of the Varnish Coating Device)

As shown in FIG. 1, the varnish coating device 10 comprises a first varnish tank 12 for storing the first varnish 11, a second varnish tank 14 for storing the second varnish 13, the mixer 15 provided at a predetermined position for mixing the first varnish 11 and the second varnish 13, pipes 16A, 16B for connecting the first varnish tank 12, the second varnish tank 13 respectively to the mixer 15, pumps 17A, 17B provided in a middle of the pipes 16A, 16B respectively for pumping the varnish to the mixer 15, a varnish bath 18 for accepting the varnish dropped from the mixer 15, coating dies 19A-19F through which the wire 3 is inserted (the coating dies 19B to 19F are installed behind the coating die 19A), tubes 20A-20F for connecting the varnish bath 18 and the coating dies 19A-19F respectively (the tubes 20B to 20F are installed behind a die holder 21), and the die holder 21 for holding the tubes 20A-20F.

In the first preferred embodiment, the first varnish tank 12, the second varnish tank 14, the mixer 15 and the pipes 16A and 16B constitute a varnish feeding part.

Figure 2:
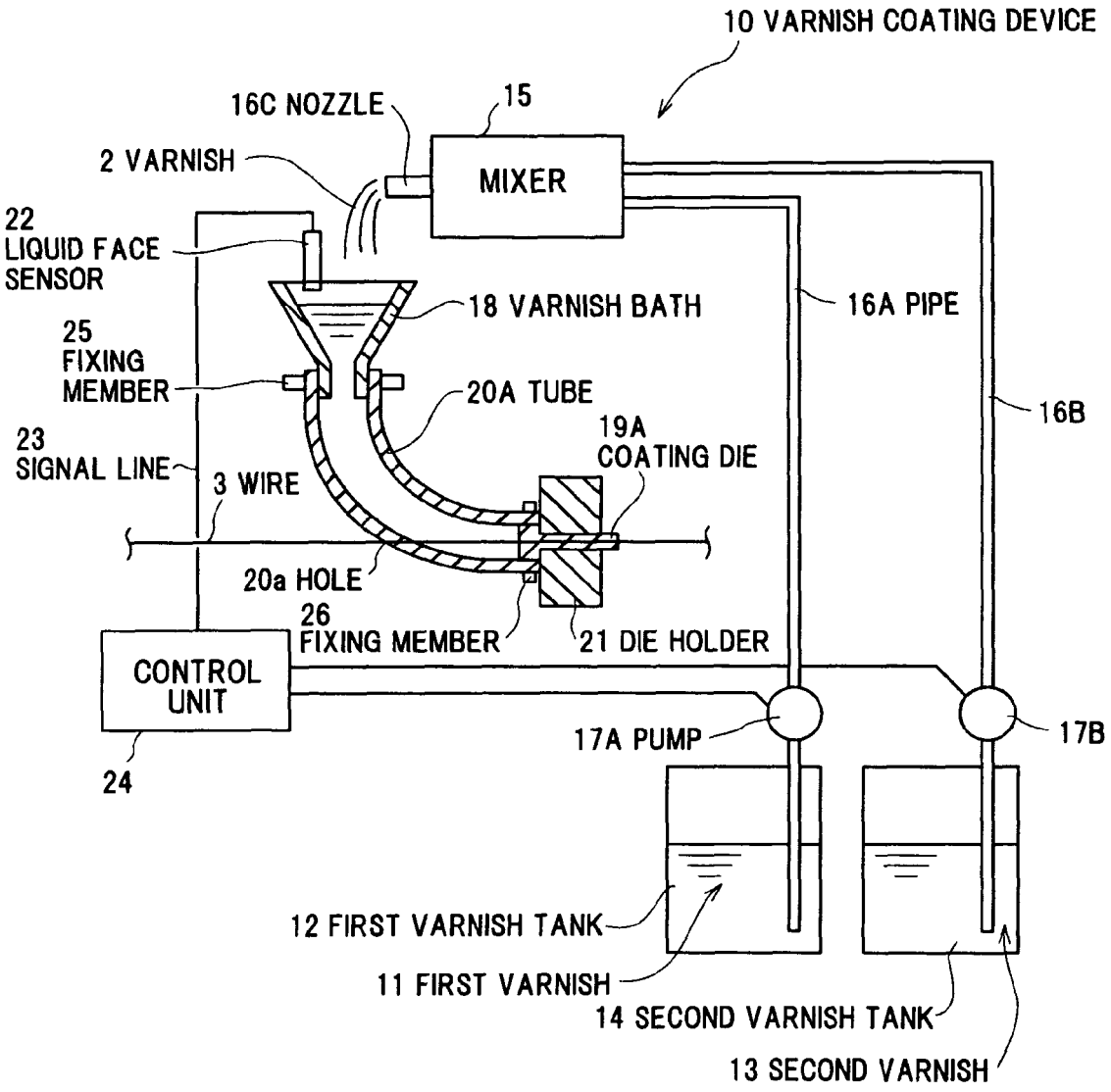
FIG. 2 is a diagram of a partial structure of the varnish coating device in the first preferred embodiment according to the present invention.

FIG. 2 is a diagram of a partial structure of the varnish coating device in the first preferred embodiment according to the present invention.

A liquid face sensor 22 is disposed at an upper part of the varnish bath 18, an output signal of the liquid face sensor 22 is input via a signal line 23 to a control board (control unit) 24 for controlling the pumps 17A, 17B. The liquid face sensor 22 is a contact or non-contact type sensor for detecting a liquid face level of the varnish. In addition, as an example, the mixer 15 is provided at a position higher than a position of the varnish bath 18 in the varnish coating device 10, however, the present invention is not limited thereto. The mixer 15 may be disposed in a position equal to or lower than the position of the varnish bath 18, in order to use a pressure of the pumps 17A, 17B.

The tubes 20A-20F are disposed with a curvature and respective upper and lower ends of tubes 20A-20F are fixed to the varnish bath 18 and the coating dies 19A-19F by means of fixing members 25, 26. The tubes 20A-20F are provided with holes 20*a* for passing the wire 3 carried by the sheave 5A to the coating dies 19A-19F. For example, these holes 20*a* are formed by attaching plural needles corresponding to the number of the wires 3 to jigs with a predetermined pitch, and inserting the needles into the tubes 20A-20F at predetermined positions along a guide.

The wire 3 is introduced into the tubes 20A-20F from the outside of the tubes 20A-20F via the hole 20*a*, and led to the coating dies 19A-19F. Therefore, it is preferable that coating dies 19A-19F are provided such that a direction of forming the die holes and a direction of passing the wire 3 are aligned linearly. In addition, it is sufficient if the tubes 20A-20F are connected such that the varnish 2 can be supplied continuously in one direction (from the varnish bath 18 to the coating dies 19A-19F) by flowing the varnish 2 by a self-weight of the varnish 2 from the varnish bath 18. Therefore, the tubes 20A-20F may be connected with a right angle from the fixing member 25 to the fixing member 26, in stead of being located with the curvature. In other words, the tubes 20A-20F may be formed to include a straight line-shaped part or an arched part with a predetermined curvature between the fixing member 25 and the fixing member 26.

The tubes 20A-20F are formed from a material in which the hole 20*a* can be formed, and the material has a hardness for keeping a configuration of the hole 20*a*, an elasticity for preventing the varnish 2 from leaking, and an insolvable characteristic that is not solved by the solvent included in the varnish 2. As for the tubes 20A-20F, for example, a fluorine-containing rubber tube, a polyethylene tube, a Si tube, a teflon tube ("Teflon" is a registered mark), a nylon tube, a PFA (tetrafluoroethylene perfluoroalkyl vinylether copolymer) tube, a FEP (tetrafluoroethylene hexafluoropropylene copolymer) tube, a vinyl tube or the like may be used.

(Structure of the Varnish Die)

Figure 3:
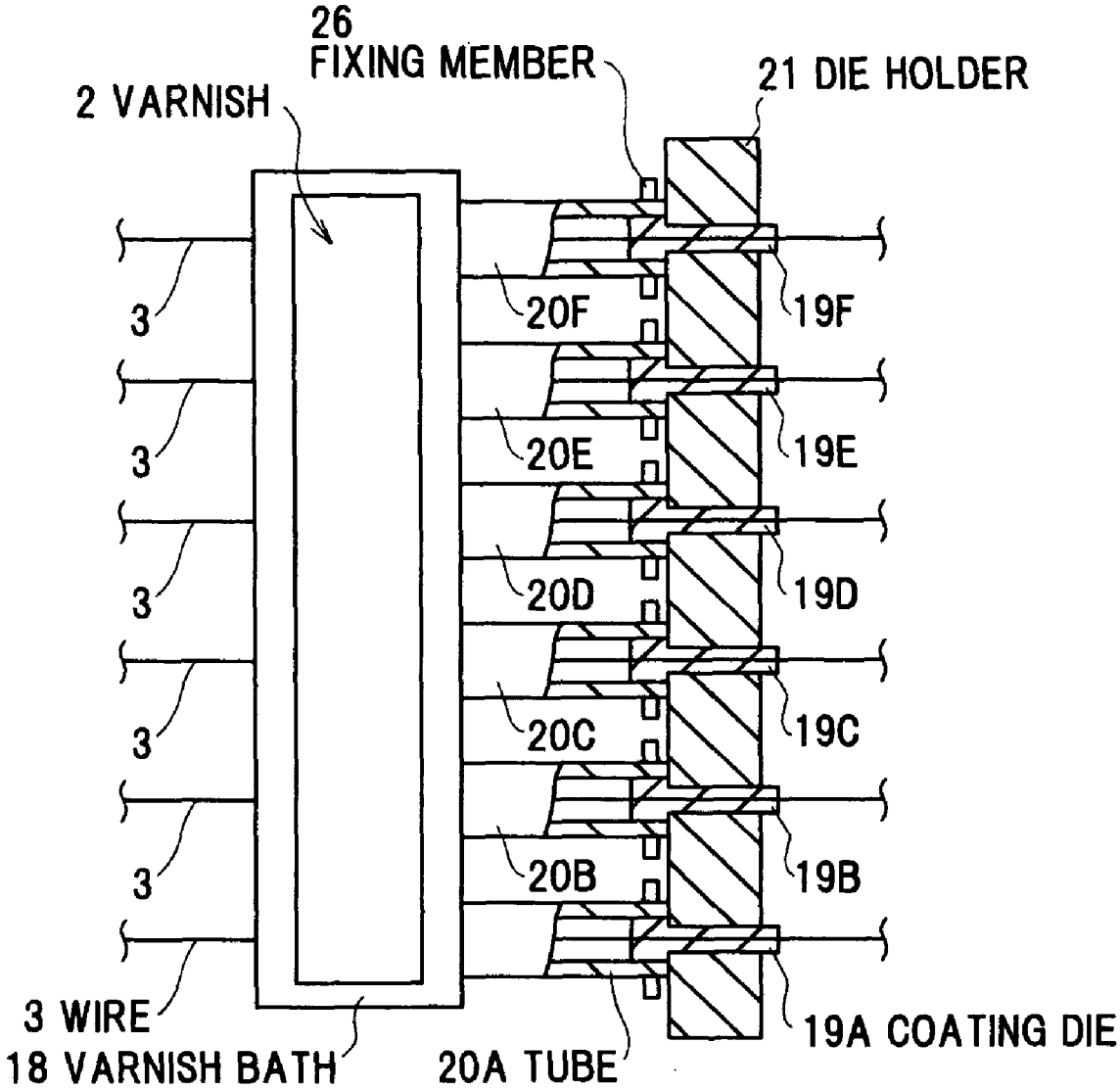
FIG. 3 is a detailed plan view of a varnish bath, tubes and coating dies of FIG. 2.
Figure 4:
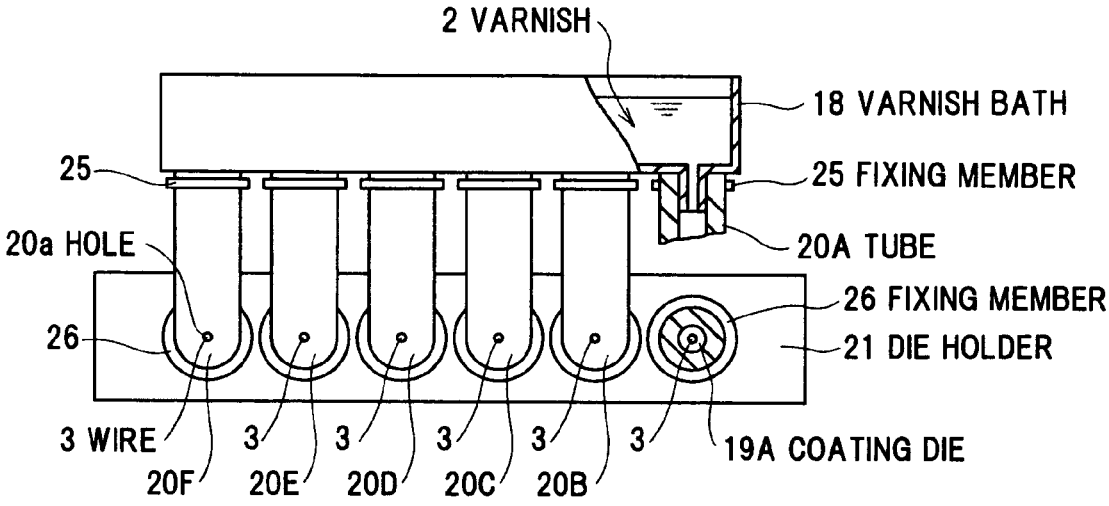
FIG. 4 is a schematic side view of the varnish bath, tubes and coating dies of FIG. 3.

FIG. 3 is a detailed plan view of the varnish bath, tubes and coating dies of FIG. 2. In addition, FIG. 4 is a schematic side view of the varnish bath, tubes and coating dies of FIG. 3. In FIGS. 3 and 4, several parts are shown along broken lines.

The coating dies 19A-19F are held with a predetermined pitch by the die holder 21, and one end of each of the tubes 20A-20F is connected to the die holder 21. Another end of each of the tubes 20A-20F is connected to the varnish bath 18 having a size approximately same as that of the die holder 21.

(Operation of the Varnish Coating System)

Next, operation of the varnish coating system will be explained below.

At first, as shown in FIG. 1, the wire 3 is installed to pass through a path of the sheave 5A→the varnish coating device 10 (the tube 20A→the coating die 19A)→the baking furnace 4→the sheave 5B→the sheave 5C→the sheave 5D→the sheave 5A as a first pass.

Furthermore, the wire 3 that has passed through the first pass is installed to pass through a path of the sheave 5B→the sheave 5C→the sheave 5D→the sheave 5A→the tube 20B→the coating die 19B→the baking furnace 4→the sheave 5B as a second pass.

Thereafter, similarly to the first and second passes, the wire 3 is installed to pass through the respective sheaves 5B, 5C, 5D, 5A, the tubes 20C-20F, the coating dies 19C-19F, and the baking furnace 4 for forming a third pass to a sixth pass, and the wire 3 drawn from the sheave 5B via the coating die 19F is carried to a cooling-system (not shown).

Next, operation of the baking furnace 4 is started and the pumps 17A, 17B are operated in accordance with an initial setting state, so that the first varnish 11 and the second varnish 13 are supplied to the mixer 15 from the first varnish tank 12 and the second varnish tank 14, respectively. Simultaneously, operation of a driving mechanism (not shown) is started, and dispensing of the wire 3, carrying of the wire 3 to the varnish coating device 10, and winding of the wire 3 by the winder are started.

The mixer 15 mixes the first varnish 11 supplied from the first varnish tank 12 and the second varnish 13 supplied from the second varnish tank 14 to provide the varnish 2, and supplies the varnish 2 by dropping the varnish 2 by the self weight to the varnish bath 18. A constant quantity of the varnish 2 supplied to the varnish bath 18 is stored in the varnish bath 18, and a predetermined quantity of the varnish is continuously dropped through the tubes 20A-20F by a gravity to be supplied to the coating dies 19A-19F, then the varnish 2 is stored in the tubes 20A-20F located at an upstream of the coating dies 19A-19F. The coating dies 19A-19F applies the varnish 2 of a quantity which corresponds to a diameter of the die hole to a surface of the wire 3 by passing the varnish 2 stored in the tubes 20A-20F and the wire 3 through the coating dies 19A-19F. By repeating the application of the varnish 2 for six times, six layers of the varnish 2 are formed on the surface of the wire 3 which is drawn from the coating die 19F, and baked by the baking furnace 4 to provide a coating film.

The tubes 20A-20F are connected by the fixing members 25, 26 to have an arch shape or a right angle with respect to the varnish bath 18 and the coating dies 19A-19F, so that the varnish 2 in the tubes 20A-20F is blocked from an outside air, and transmitted to one direction (from the varnish bath 18 to the coating dies 19A-19F) without leaking from the tubes 20A-20F. As described above, the varnish bath 18 and coating dies 19A-19F are located with a level difference such that the varnish 2 is flown through the tubes 20A-20F without staying in the tubes 20A-20F, so that the varnish 2 can be applied to the wire 3 without curing.

The liquid face level of the varnish 2 in the varnish bath 18 is detected by the liquid face sensor 22 by every predetermined time period, and a detected result is sent to the control unit 24 as the output signal Ss. The control unit 24 controls the pumps 17A, 17B based on the output signal Ss, to keep the liquid face level of the varnish 2 in the varnish bath 18 at a predetermined level.

As for the wire 3 on which the varnish 2 is applied by the coating dies 19A-19F, the solvent contained in the varnish 2 is evaporated in the process of passing the wire 3 through the baking furnace 4, and the baked varnish 2 is adhered to the surface of the wire 3. As for the evaporated solvent, a harmful component and an environmental disruption component are removed by the catalytic device 6, and other vaporized components are exhausted from the exhaust duct 7 to the atmosphere.

(Effect of the First Preferred Embodiment)

According to the first preferred embodiment, the two-pack type varnish 2 that transforms in a short time is flown by the self weight through the tubes 20A-20F that are installed to prevent the varnish 2 from leaking, to be supplied to the coating dies 19A-19F in a short time without stagnation. As a result, it is possible to prevent the varnish 2 from curing and thickening by blocking a contact of the varnish coated on the wire with the outside air, thereby realizing the application utilizing advantages of the two-pack type varnish. In addition, the upper part of the varnish bath 18 may be covered by a lid in order to prevent the varnish 2 from contamination by grits and dusts, to the extent that the lid does not disturbs feeding of the varnish 2.

(Second Preferred Embodiment)

Figure 5:
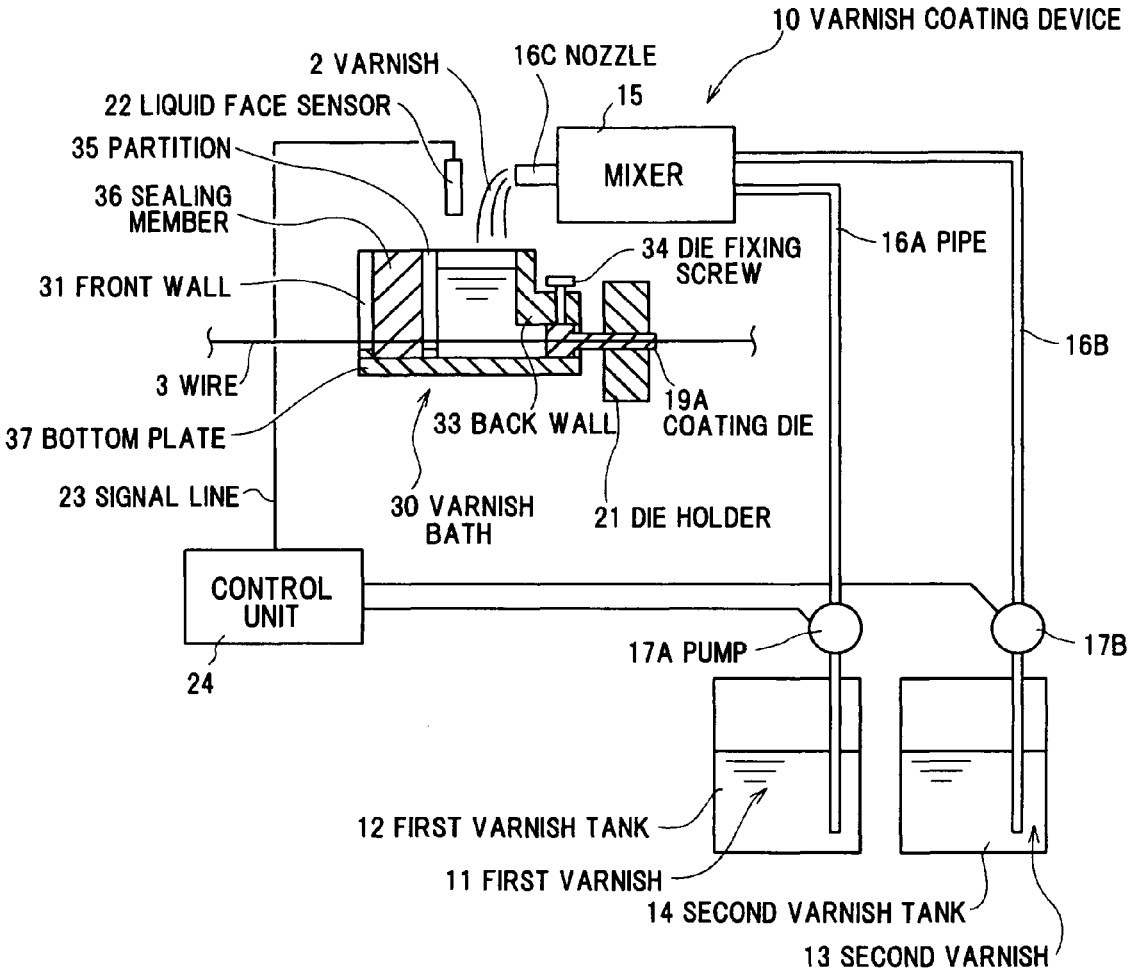
FIG. 5 is a schematic diagram of a varnish coating device in a second preferred embodiment according to the present invention.

FIG. 5 is a schematic diagram of a varnish coating device in a second preferred embodiment according to the present invention.

A varnish coating device 10 in the second preferred embodiment is similar to the varnish coating device 10 in the first preferred embodiment, except that a varnish bath 30 having an L-shape is directly connected to the coating dies in place of providing the tubes 20A-20F in the first preferred embodiment. In the following explanation, same reference numerals indicate parts having similar structure and function. In this preferred embodiment, the varnish bath 30 having the L-shape is used, however, the present invention is not limited thereto. Similar effect can be obtained by providing the varnish bath having a configuration for supplying the varnish 2 to the coating dies 19A-19F without stagnation of the varnish 2.

Figure 6:
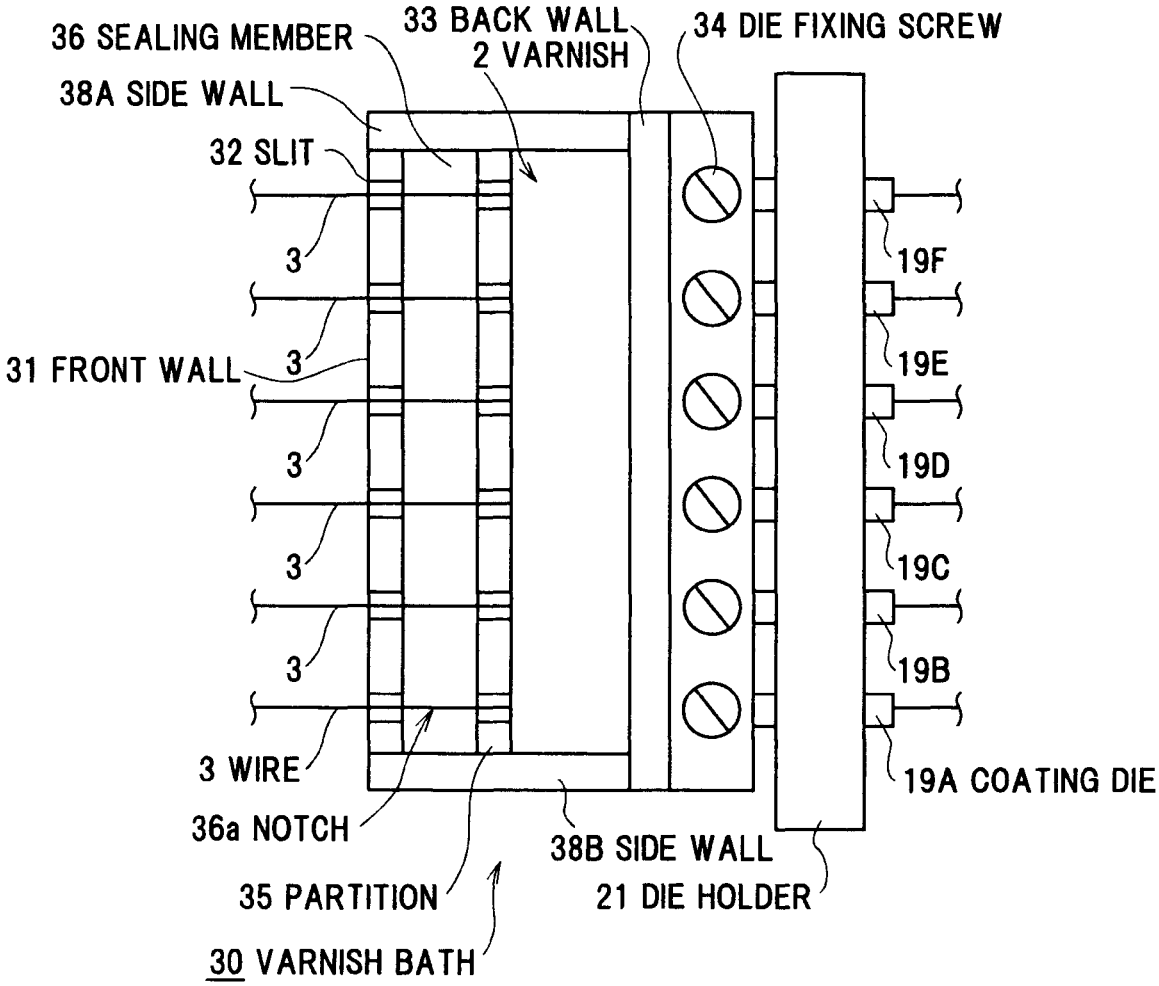
FIG. 6 is a plan view of a varnish bath of FIG. 5.
Figure 7:
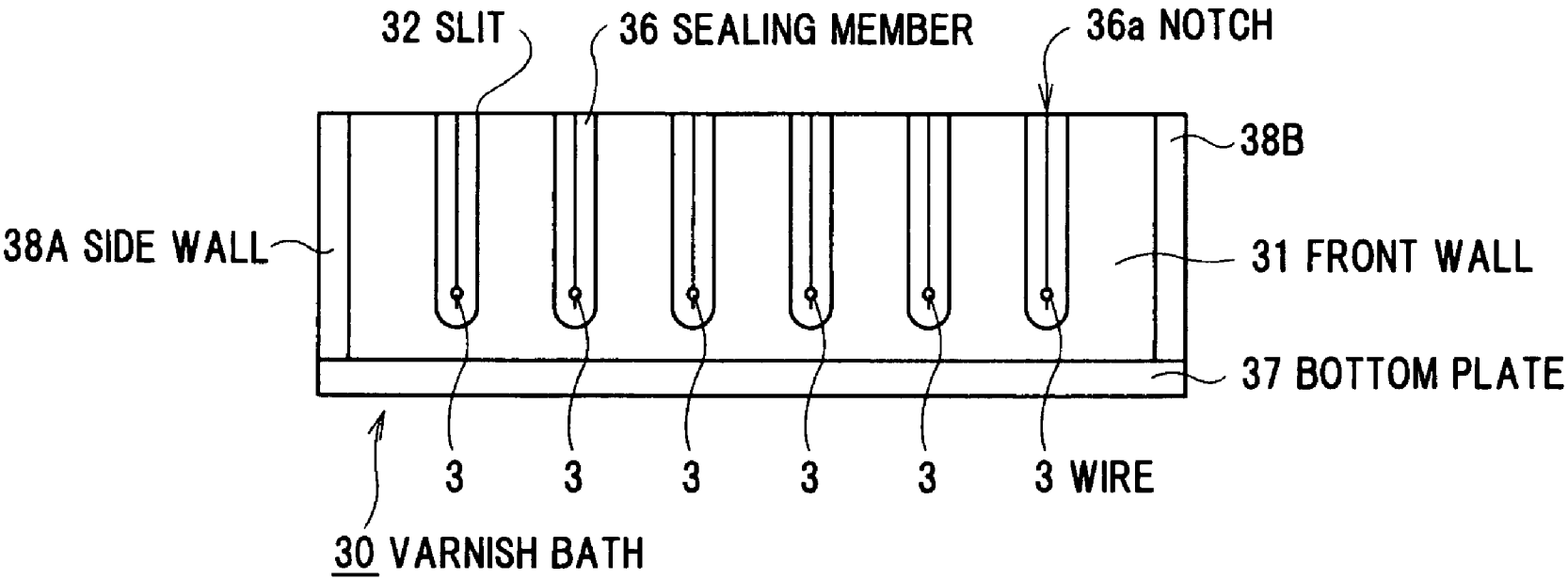
FIG. 7 is a side view of the varnish bath of FIG. 6 viewed from a wire introducing side.

FIG. 6 is a plan view of the varnish bath of FIG. 5. FIG. 7 is a side view of the varnish bath of FIG. 6 viewed from a wire introducing side.

The varnish bath 30 has a shape of a box with a rectangular opening at an upper part, a front wall 31 is provided on a bottom plate 37 in perpendicular to side walls 38A, 38B, and six slits 32 for passing the wire 3 are formed at the front wall 31. A die fixing screw 34 is provided at a back wall 33 on the bottom plate 37 in order to hold an entrance of the coating dies 19A-19F. Inside of the varnish bath 30 is divided into a front part and a back part (the front part is a part where the slits 32 are provided, and the back part is a part where the coating dies 19A-19F are provided) by a partition 35, and a sealing member 36 having notches 36*a* is interposed between the front wall 31 and the partition 35, in order to insert the wire 3 from the upper opening to a predetermined position.

In this preferred embodiment, the wire 3 is installed into the coating dies 19A-19F through the slits 32 and the sealing member 36. Other path for passing the wire 3 is similar to that of the first preferred embodiment. The varnish 2 supplied from the mixer 15 is flown to and stored in the varnish bath 30, and the varnish 2 is supplied from a lower part of the varnish bath 30 to the coating dies 19A-19F to be applied to the wire 3.

According to the second preferred embodiment, a path for flowing the varnish 2 to the coating dies 19A-19F is not always in one direction. However, the varnish 2 is stored in the upstream side of the coating dies 19A-19F. When there is much consumption, the varnish 2 can be supplied to the coating dies 19A-19F almost without stagnation.

Further, according to the second preferred embodiment, it is possible to apply the varnish 2 on the wire without stagnation, by continuously flowing the varnish 2 in the varnish bath 30 toward the coating dies 19A-19F, by utilizing a vortex of the varnish 2 occurring at a periphery of the wire 3 when the wire 3 passes from the varnish bath 30 to the coating dies 19A-19F.

It is preferable that the varnish bath 30 has a volume to be affected by the vortex of the varnish 2 that occurs at the periphery of the wire 3. For example, when a varnish quantity supplied from the coating dies 19A-19F to the wire 3 per one minute is T (cc/minute), a time required for curing the varnish 2 after the varnish 2 is supplied to the varnish bath 30 is t (minute), the varnish 2 can be flown without curing in the varnish bath 30 by having the volume not greater than T×t (cc). In other words, it is preferable to provide the varnish bath 30 with the volume not greater than T×t (cc), for the purpose of suppressing the curing of the varnish 2 and keeping a flowability of the varnish 2.

In the varnish bath 30, a pitch p of adjacent wires 3 is within a range from 5 to 20 mm, and preferably within a range from 5 to 10 mm. If the pitch p is greater than 20 mm, there may be a case in that the vortex is hard to occur at the periphery of the wire 3. If the pitch p is smaller than 5 mm, the varnish 2 flows too much, and it may be difficult to supply the varnish 2 stably to the coating die. At this time, a viscosity of the varnish 2 is within a range from 0.1 to 10 Pa·s, and preferably within a range from 0.1 to 10 Pa·s. It is possible to generate the vortex at the periphery of the wire 3, by appropriately adjusting a viscosity of the varnish 2 and a pitch of the wires 3 to be within the aforementioned ranges, and a distance of traveling of the wire 3 in the varnish bath 30 per a unit hour to be within a range from 10 to 200 mm. According to this structure, the varnish 2 in the varnish bath 30 flows continuously toward the coating dies 19A-19F, and the varnish 2 can be supplied to the coating dies 19A-19F without stagnation. Accordingly, although there is a little curing of the varnish 2 in the varnish bath 30 that will not affect on the fabrication, it is possible to realize the operation for a long time (continuous operation, for example, for more than 24 hours). In addition, it is preferable that the control unit 24 controls the operation of the pumps 17A, 17B based on the signal from the liquid face sensor 22, to maintain the liquid face level of the varnish 2 in the varnish bath 30 to be constant within a range from 10 to 20 mm from the bottom of the varnish bath 30.

(Third Preferred Embodiment)

Figure 8:
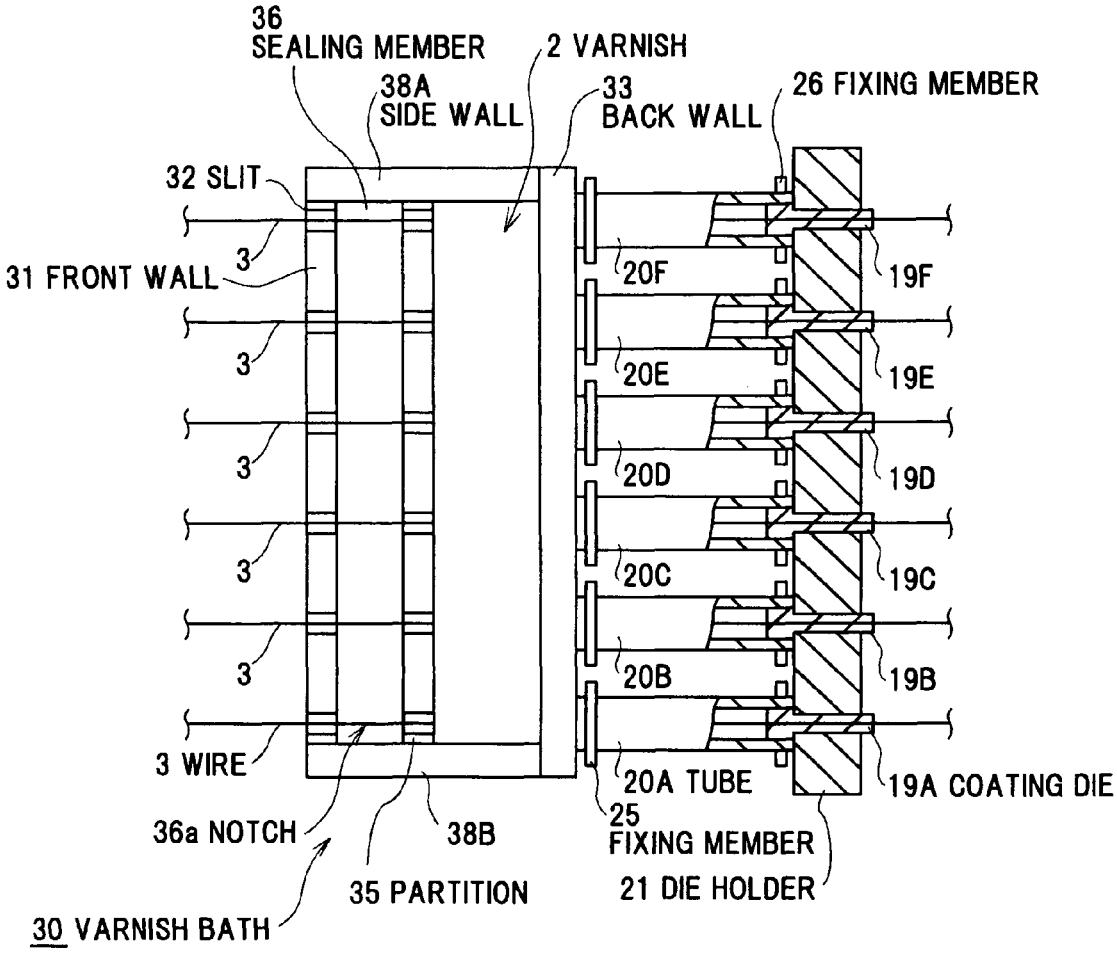
FIG. 8 is a plan view of a main part of the varnish coating device in a third preferred embodiment according to the present invention.
Figure 9:
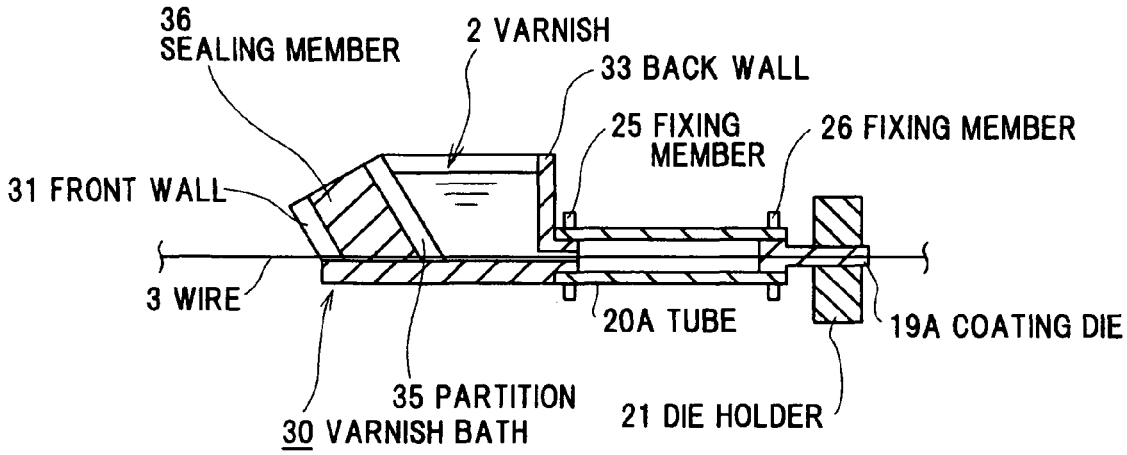
FIG. 9 is a cross sectional view of the varnish coating device shown in FIG. 8.

FIG. 8 is a plan view of a main part of the varnish coating device in a third preferred embodiment according to the present invention. FIG. 9 is a cross sectional view of the varnish coating device shown in FIG. 8. In FIG. 8, a part of the tube is shown along broken line.

A varnish coating device 10 in the third preferred embodiment is similar to the varnish coating device 10 in the second preferred embodiment, except that the varnish bath 30 and the coating dies 19A-19F are provided separately and connected with each other by the tubes 20A-20F, and the front wall 31 and the partition 35 of the varnish bath 30 are inclined. In addition, since a method for installing the wire 3 and a method for applying the varnish 2 in the varnish coating device 10 to the wire 3 are similar to those in the second preferred embodiment, therefore, the explanation thereof is omitted.

According to the third preferred embodiment, it is possible to reduce the stagnation of the varnish 2 to be supplied to the coating dies 19A-19F by providing the tubes 20A-20F between the back wall 33 of the varnish bath 30 and the coating dies 19A-19F, compared with the second preferred embodiment.

EXAMPLE 1

Next, examples of the preferred embodiment according to the present invention will be explained below.

The Inventors of the present invention studied examples under following conditions by using the varnish coating system 1 shown in FIG. 1.

A copper wire having a conductor diameter of 0.40 mm was used as the wire 3. The varnish 2 was the two-pack type varnish formed by mixing the first varnish 11 and the second varnish 13, that cannot be applied due to its thickening if about 30 minutes are elapsed after mixing. The varnish 2 was applied and baked to the wire 3 to have a film thickness of 0.015 mm, to provide an enamel wire.

As for the first varnish 11 of the two-pack type varnish, an isocyanate group-containing urethane prepolymer solution containing 70 weight % of non-volatile component (manufactured by Auto Chemical Industry Co., Ltd.) was used. As for the second varnish 13 of the two-pack type varnish, a polyester polyol solution containing 70 weight % of non-volatile component (manufactured by Auto Chemical Industry Co., Ltd.) was used.

In the varnish coating device 1, an inner diameter of the coating die 19A for the first pass was 0.43 mm, an inner diameter of the coating die 19B for the second pass was 0.46 mm, inner diameters of the coating dies 19C to 19F for the third pass to the sixth pass were increased by 0.03 mm, a coating rate (=a traveling speed of the wire 3) was 50 m/minute, and a baking temperature was within a range from 350 to 410° C. For one pass, a varnish consumption was 1.3 cc/min, an inside volume of each of the coating dies 19A-19F was 0.1 cc, and an inside volume of the tube was 2.8 cc. In addition, the varnish coating device 10 was such designed that a volume of the varnish bath 18 for six passes was 21.6 cc.

As a result, it is confirmed that a usage of the varnish 2 was finished in five minutes in the varnish coating device 10. Further, the varnish 2 in the varnish coating device 10 was not cured even after the continuous operation for 24 hours.

As described above, according to the varnish coating system 1 of the present invention, even though the wire 3 is coated by using the two-pack type varnish 2 that transforms in accordance with the elapse of the time, so that it is possible to stably apply the varnish 2 to the wired rod 3 without curing the varnish 2.

EXAMPLE 2

Next, the Inventors of the present invention studied the varnish coating system 1 comprising varnish coating device 10 shown in FIG. 5.

A copper wire having a conductor diameter of 0.40 mm was used as the wire 3. The two-pack type varnish 2 was formed by mixing the first varnish 11 comprising the isocyanate group-containing urethane prepolymer solution containing 70 weight % of non-volatile component (manufactured by Auto Chemical Industry Co., Ltd.), and the second varnish 13 comprising the polyester polyol solution containing 70 weight % of non-volatile component (manufactured by Auto Chemical Industry Co., Ltd.). The varnish 2 was applied and baked to the wire 3 to have a film thickness of 0.032 mm, to provide an enamel wire.

In the varnish coating device 1 of the Example 2, an inner diameter of the coating die 19A for the first pass was 0.43 mm, an inner diameter of the coating die 19B for the second pass was 0.44 mm, inner diameters of the coating dies 19C to 19F for the third pass to the sixth pass were increased by 0.01 mm, a coating rate (=a traveling speed of the wire 3) was 50 m/minute, and a baking temperature was within a range from 350 to 410° C. For one pass, a varnish consumption was 0.5 cc/min, and an inside volume of each of the coating dies 19A-19F was 0.25 cc. The varnish coating 10 was such designed that a volume of the varnish bath 30 shown in FIG. 6 for six passes was 36.0 cc (the varnish 2 in the varnish bath 30=24.0 cc), a pitch of the adjacent wires 3 was 10 mm, and a liquid face level of the varnish 2 was kept at 20 mm from the bottom of the varnish bath 30 to provide a constant quantity of the varnish 2.

As a result, in the varnish coating device 10 of the Example 2, the stagnation of the varnish 2 in the varnish bath 30 due to the curing was not occurred, a stable vortex was generated at the periphery of the wire 3, so that the varnish 2 was flown continuously toward the coating dies, and it was possible to supply the varnish 2 to the coating dies without stagnation. Even after the continuous operation for 24 hours, it was possible to stably apply the varnish to the wire 3 without curing the varnish 2 in the varnish coating device 10.

EXAMPLE 3

Next, the Inventors of the present invention studied the varnish coating system 1 comprising the varnish coating device 10 shown in FIGS. 8 and 9.

A copper wire having a conductor diameter of 0.40 mm was used as the wire 3. The two-pack type varnish 2 formed by mixing the first varnish 11 and the second varnish 13 similar to that in the Example 2 was used. The varnish 2 was applied and baked to the wire 3 to have a film thickness of 0.032 mm, to provide an enamel wire.

In the Example 3, the enamel wire was manufactured by applying and baking the varnish 2 on the wire 3 by a method similar to that in the Example 2, except that the varnish bath 30 having a volume (36.0 cc) similar to that in the Example 2 and the tubes 20A-20F having a volume (2.8 cc) similar to that in the Example 1 are connected the fixing member 25. In addition, a quantity of the varnish 2 in the varnish bath 30 in the Example 3 was 24.0 cc similarly to that in the Example 2.

As a result, in the varnish coating device 10 of the Example 3, the stagnation of the varnish 2 in the varnish bath 30 due to the curing was not occurred, a stable vortex was generated at the periphery of the wire 3, so that the varnish 2 was flown continuously toward the coating dies, and it was possible to supply the varnish 2 to the coating dies without stagnating. Even after the continuous operation for 24 hours, it was possible to stably apply the varnish to the wire 3 without curing the varnish 2 in the varnish coating device 10.

The present invention is not limited to the respective preferred embodiments and the examples, and various modifications are possible without going beyond the scope of the invention. For example, elements in the respective preferred embodiments may be combined arbitrarily.

For example, in the respective preferred embodiments, the varnish coating device 10 is a horizontal type varnish coating device in which the coating path and the baking furnace 4 are arranged horizontally (in a direction perpendicular to a direction of the gravity). However, the present invention is not limited thereto. The varnish coating device 10 may be a vertical type varnish coating device in which in which the coating path and the baking furnace 4 are arranged vertically (in a direction parallel to a direction of the gravity).

In the respective preferred embodiment according to the present invention, the two-pack type varnish was used as the varnish 2, however, the present invention is not limited thereto. As for the varnish 2, an n-pack type (n is a positive integer) varnish such as three-pack type varnish, four-pack type varnish that is formed by mixing a varnish material A, a varnish material B, and a plurality of varnish materials each having a functional group which is different from that of the varnish materials A, B may be used.

Furthermore, the conventional one-pack type varnish may be also used as the varnish 2. In this one-pack type varnish, the circulation of the varnish conducted in the conventional varnish coating device is not required. Therefore, it is possible to apply and bake the varnish with less impurity compared with the conventional device.

In the respective preferred embodiments according to the present invention, the quantity of the varnish in the varnish bath is controlled to be constant, by detecting the liquid face level of the varnish in the varnish bath by locating the liquid face sensor at the upper part of the varnish bath. However, the present invention is not limited thereto. For example, it is possible to automatically control the quantity of the varnish stored in the varnish bath to be constant, by methods using a load sensor for detecting a weight of the varnish bath, and a contact sensor such as a limit sensor or a non-contact sensor using a variation in a static capacitance or optical characteristic for detecting the liquid face level.

Still further, in the second and third preferred embodiments according to the present invention, a partition member for classifying the wires 3 respectively may be provided in the varnish bath 30.

In the partition member, a shape of the cross section perpendicular to the traveling direction of the wire 3 is not limited, and may be triangular, rectangular or the like. In addition, it is preferable that the partition member has a height from the bottom of the varnish bath 30 that is lower than the liquid face level of the varnish 2 with the constant quantity (however, higher than the position of the wiring rod 3). By providing such a partition member, it is possible to further relax the stagnation of the varnish 2.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A varnish coating device, comprising:

a coating die for applying a varnish to a wire;

a varnish bath for supplying the varnish to the coating die by a self weight of the varnish; and a varnish feeding part, comprising a mixer configured to mix a plurality of varnish materials, for supplying the varnish made by mixing the plurality of varnish materials within the mixer to the varnish bath by dropping the varnish by its self weight to the varnish bath, wherein the coating die is located below a liquid surface of the varnish bath.

2. The varnish coating device, according to claim 1, wherein the varnish bath is configured to flow the varnish toward the coating die without stagnation.

3. The varnish coating device, according to claim 1, wherein the varnish bath is connected to the coating die to have an L-shape.

4. The varnish coating device, according to claim 1, wherein the coating die is provided with a hole for inserting the wire, and a direction of the hole is aligned with a direction of passing the wire.

5. The varnish coating device, according to claim 1, wherein the varnish bath is connected to the coating die directly or via a tube.

6. The varnish coating device, according to claim 5, wherein the tube is connected to the coating die with a curvature or a right angle.

7. The varnish coating device, according to claim 6, wherein the tube comprises a material that has an elasticity and an insolvability with a solvent contained in the varnish.

8. The varnish coating device, according to claim 1, further comprising:

a sensor for detecting a quantity of the varnish supplied to the varnish bath; and a control unit for controlling the quantity or the varnish supplied to the varnish bath based on a detection result of the sensor.

9. The varnish coating device, according to claim 1, wherein the coating die is located at an advanced position with respect to a passing direction of the wire.

10. The varnish coating device, according to claim 1, wherein the varnish supplied from the varnish bath is stored at an upstream side of the coating die.

11. The varnish coating device, according to claim 1, wherein the coating die applies the varnish of a quantity corresponding to a diameter of a die hole of the coating die to a surface of the wire.

12. The varnish coating device, according to claim 1, wherein the varnish bath is connected to the coating die in such manner that a predetermined quantity of the varnish in the varnish bath drops by its self weight to be continuously supplied to the coating die.

13. The varnish coating device, according to claim 1, wherein the varnish bath has a volume not greater than $T \times t$ (cc), wherein a varnish quantity supplied from the coating die to the wire per one minute is T (cc/minute), and a time required for curing the varnish after the varnish is supplied to the varnish bath is t (minute).

14. The varnish coating device, according to claim 1, wherein the varnish bath is configured to supply the varnish to the coating die without circulation.

15. The varnish coating device, according to claim 1, wherein the varnish feeding part comprises a first varnish tank which stores a first varnish and a second varnish tank which stores a second varnish.

* * * * *